US005119420A

United States Patent [19]

Kato et al.

[11] Patent Number: 5,119,420

[45] Date of Patent: Jun. 2, 1992

[54] DEVICE FOR CORRECTING A SOUND FIELD IN A NARROW SPACE

[75] Inventors: Shinjiro Kato; Hisashi Kihara; Fumio Tamura; Shuichi Mori, all of Saitama, Japan

[73] Assignee: Pioneer Electronic Corporation, Tokyo, Japan

[21] Appl. No.: 540,248

[22] Filed: Jun. 19, 1990

[30] Foreign Application Priority Data

Nov. 29, 1989 [JP] Japan ..... 1-309547

[51] Int. Cl.[5] ..... H04S 1/00

[52] U.S. Cl. ..... 381/1; 381/86; 381/63

[58] Field of Search ..... 381/97, 86, 1, 63

[56] References Cited

U.S. PATENT DOCUMENTS 3,214,519 10/1965 Fouqué .
4,219,696 8/1980 Kogure et al. .
4,309,570 1/1982 Carver .
4,329,544 5/1982 Yamada .
4,648,117 3/1987 Kunungi et al. .
4,769,843 9/1988 Imai et al. ..... 381/86
4,868,878 9/1989 Kunugi et al. ..... 381/1
4,903,307 2/1990 Ozawa et al. ..... 381/86
4,908,858 3/1990 Ohno ..... 381/1
4,972,489 11/1990 Oki et al. ..... 381/86

FOREIGN PATENT DOCUMENTS 2716039 3/1985 Fed. Rep. of Germany .
0163500 7/1987 Japan ..... 381/86

OTHER PUBLICATIONS

J.P. 62-110400A Patent Abstracts of Japan.

*Primary Examiner*—Forester W. Isen
*Assistant Examiner*—Sylvia Chen
*Attorney, Agent, or Firm*—Sughrue, Mion, Zinn, Macpeak & Seas

[57] ABSTRACT

A sound field correcting device provides for a natural acoustic localization of the outputs of right and left channels of an acoustic sound source. At least one of right and left channel audio signals is delayed to create a phase difference between the right and left channel audio signals, and to thus dislocate a sound in such a way that a listener not positioned equidistant between right and left channel sound sources may perceive the two channels equally.

4 Claims, 4 Drawing Sheets

DEVICE FOR CORRECTING A SOUND FIELD IN A NARROW SPACE

BACKGROUND OF THE INVENTION

The present invention relates to a sound field correcting device for providing a natural acoustic localization of acoustic outputs of the right and left channels in a narrow space such as inside of a motor vehicle.

A distance between two human ears, in connection with a wavelength of a sound wave reaching each ear, constitutes one of the major factors used in determining an acoustic space impression. A phase difference between the sound waves reaching both ears is greatly influenced by the low frequency components of the sound wave whose wavelength is substantially equal to the distance between the ears, and the sound wave has a unique directivity pattern. A man perceives an acoustic space impression on the basis of the difference of level and phase between the sound waves reaching the ears, directivity patterns of the sound wave, and the like.

A quantity representing an auditory correlation between the ears, an interaural correlation coefficient $\rho LR$ has been used, and is expressed by $$\rho LR = \frac{PL(t) \cdot PR(t)}{\sqrt{\{PL(t)\}^2} \cdot \sqrt{\{PR(t)\}^2}} \quad (1)$$

where PL(t) and PR(t) are sound pressures applied to the right and left ears, $\overline{PL)}$/ and $\overline{PR)}$/ are time average values of PL(t) and PR(t).

When the interaural correlation coefficient $\rho LR$ approaches $-1$, the auditory perspective and extensity become smaller. At a value of approximately 0 (zero) of the coefficient $\rho LR$, the auditory extensity becomes large. When the coefficient approaches $+1$, the auditory perspective becomes large.

Let us consider the equation (1) in a situation that in an ordinary listening room, a couple of speakers driven in phase are placed, and a listener is located at a position distanced equally from the speakers. In low and medium frequencies of sound the coefficient $\rho LR$ is substantially $+1$ (under this condition, a sound wave reaches the right and left ears in the same phase). In high frequencies, the phases of the sound wave reaching both ears have no correlation, because a wavelength of the sound wave is shorter than a distance between the ears. Accordingly, the coefficient $\rho LR$ tends to approach to "0" for high frequencies.

In a narrow space, for example, a space inside a motor vehicle, seat positions are unequally distanced from the right and left speakers. Accordingly, the coefficient $\rho LR$ at each seat position tends to approach $-1$, because of the reflection of a sound wave, and because of the asymmetry of a sound source and an acoustic space as perceived from each seat position. The coefficient $\rho LR$ was measured in the condition that a car driver hears the sounds from only the right and left front door speakers by using a microphone of a dummy head, at a driver's seat in a motor vehicle of the right-hand steering type. The results of the measurement is as shown in FIG. 6. As clearly seen from the graph, the coefficient $\rho LR$ changes from positive values to negative values in the low and medium frequency regions (the phase of the sound waves at both ears is inverted). This would cause uncomfortable sounds, such as dangling of sound and unclearness of localization.

To correct an acoustic field attended with such an uncomfortable sound, all-pass filters of the second order, by convention, are inserted in the audio signal lines of the right and left channels, respectively. In this case, the all-pass filters are selected so as to have different frequency characteristics as shown in FIG. 7(*a*). With the different frequency characteristics, a phase difference between the sound waves of the right and left channels is shaped as shown in FIG. 7(*b*) Accordingly, the coefficient $\rho LR$ can be improved to be much better than 0 (zero) even in the medium frequency region. A sound is thus dislocated to the front or toward the listener.

The sound field correcting device using the all-pass filters, however, requires complicated filters and hence is expensive to manufacture.

SUMMARY OF THE INVENTION

Accordingly, an object of the present invention is to provide a device for correcting a sound field in a narrow space which can dislocate a sound image to the front in such a narrow space that a listener is placed at a position unequally distanced from the right and left sound sources, with a simple arrangement and a low cost.

According to the present invention, there is provided a device for correcting a sound field in a narrow space comprising first delay means inserted in an audio signal line of at least one of right and left channels, the first delay means delaying the at least one of the audio signals and producing a predetermined phase difference of the audio signal in a predetermined band width.

In the sound field correcting device, the first delay means delays at least one of the audio signals and produces a predetermined phase difference of the audio signal in a predetermined band width. Even in a situation where a listener is placed at a position unequally distanced from the right and left sound sources, the coefficient $\rho LR$ can be made to approach "1".

BRIEF DESCRIPTION OF THE DRAWINGS

FIG. 7(*b*) is a graph showing a variation of a phase difference of the all-pass filter between right and left channels.

DETAILED DESCRIPTION OF THE PREFERRED EMBODIMENTS

Preferred embodiments of the present invention will be described with reference to the accompanying drawings.

Figure 1:
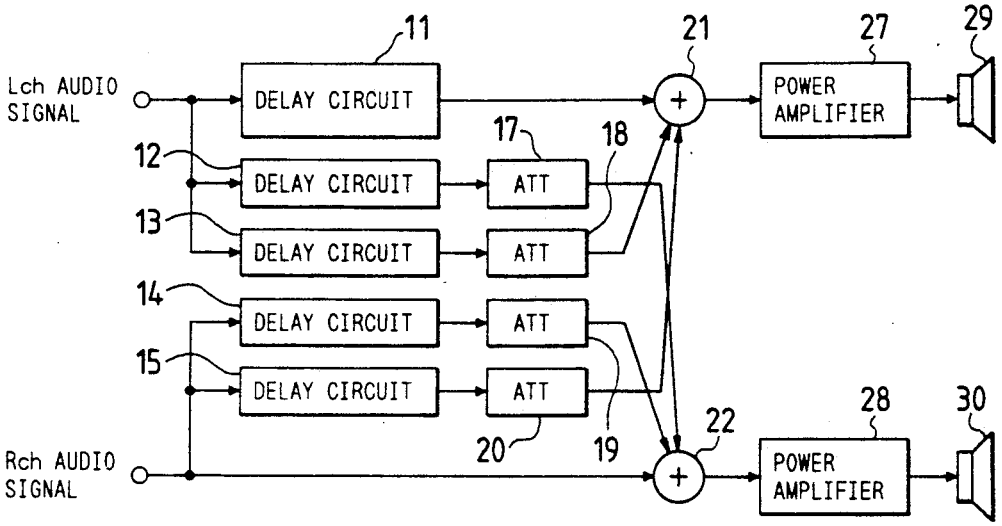
FIG. 1 is a block diagram showing an embodiment of the present invention.

In FIG. 1, audio signals of the left and right channels (referred to as Lch and Rch, respectively) are generated by a signal source (not shown). Of those audio signals, the audio signal of the Lch is applied to delay circuits 11, 12 and 13. The audio signal of the Rch is applied to delay circuits 14 and 15, and to an adder 22. Each of the delay circuits 11 to 15 is constructed using a delay element, e.g., BBD (bucket brigade device), or a digital circuit. The outputs of the delay circuits 12 to 15 are respectively coupled with ATTs (attenuators) 17 to 20. The output of the delay circuit 11 is connected to an adder 21. The adder 21 adds together the output levels of the delay circuit 11, and the ATTs 18 and 20. The adder 22 adds together an output level of the audio signal of the Rch, and the output levels of the ATTs 17 and 19. The output signal of the adder 21 serves as an output signal of the front Lch (left channel) of the instant sound field correcting device, and the output signal of the adder 22, as an output signal of the front Rch (right channel). The delay circuits 12 to 15, ATTs 17 to 20, and adders 21 and 22 make up means for generating early reflection signals.

The output signals of the front Lch and Rch are respectively amplified by power amplifiers 27 and 28, and are then applied to speakers 29 and 30 respectively.

With such an arrangement, an audio signal of the Lch is delayed at a preset time $\tau_2$ by the delay circuit 12, and is attenuated by the ATT 17. Further, it is delayed by a preset time $\tau_3$ by the delay circuit 13, and is attenuated by the ATT 18. An audio signal of the Rch is delayed by a preset time $\tau_4$ by the delay circuit 14, and is attenuated by the ATT 19. Further, it is delayed by a preset time $\tau_5$ by the delay circuit 15, and is attenuated by the ATT 20. The output signals of the ATTs 17 to 20, respectively, serve as early reflection signals The audio signal of the Lch is delayed by a preset time $\tau_1$ by the delay circuit 11, and the delayed signal is applied as a direct sound signal of the Lch to the adder 21. The early reflection signal derived from the ATT 18 is a pseudo-reflected sound signal as generated based on the assumption that a reproduced sound of the Lch is reflected on the left wall, and reaches the left ear of a listener. The early reflection signal derived from the ATT 20 is a psuedo-reflected sound signal as generated based on the assumption that a reproduced sound of the Rch is reflected on the left wall, and reaches the left ear of a listener. Those early reflection signals are applied to the adder 21 where they are added to the direct sound signal. The output signal of the adder 21 is amplified by the power amplifier 27, and is output as an acoustic signal of the Lch from the speaker 29.

The audio signal of the Rch is straightforwardly applied as a direct sound signal of the Rch to the adder 22. The early reflection signal derived from the ATT 17 is a pseudo-reflected sound signal as generated based on the assumption that a reproduced sound of the Lch is reflected on the right wall, and reaches the right ear of a listener. The early reflection signal derived from the ATT 19 is a pseudo-reflected sound signal as generated based on the assumption that a reproduced sound of the Rch is reflected on the right wall, and reaches the right ear. Those early reflection signals are applied to the adder 22 where they are added to the direct sound signal of the Rch. The output signal of the adder 22 is amplified by the power amplifier 28, and is output as an acoustic signal of the Rch from the speaker 30.

The delay time $\tau_1$ of the delay circuit 11 creates a time difference between the audio signals of the Lch and the audio signals of the Rch so that those signals are out of phase in the medium frequency region from 250 Hz to 800 Hz. The delay time $\tau_1$ is uniform over the entire frequency region from low to high. However, a phase shift of the signal due to the delay becomes larger as the frequency of the signal becomes higher. By making use of this relationship, the delay time is selected so that, a phase shift of approximately 180° is obtained in the medium frequency region. The delay time $\tau_1$ created by the delay circuit 11 is shorter than any of the remaining preset delay times $\tau_2$ to $\tau_5$. As specific values, $\tau_1$ is 0.5 to 2.5 msec, and $\tau_2$ to $\tau_5$ are each 3 msec or more.

Figure 2:
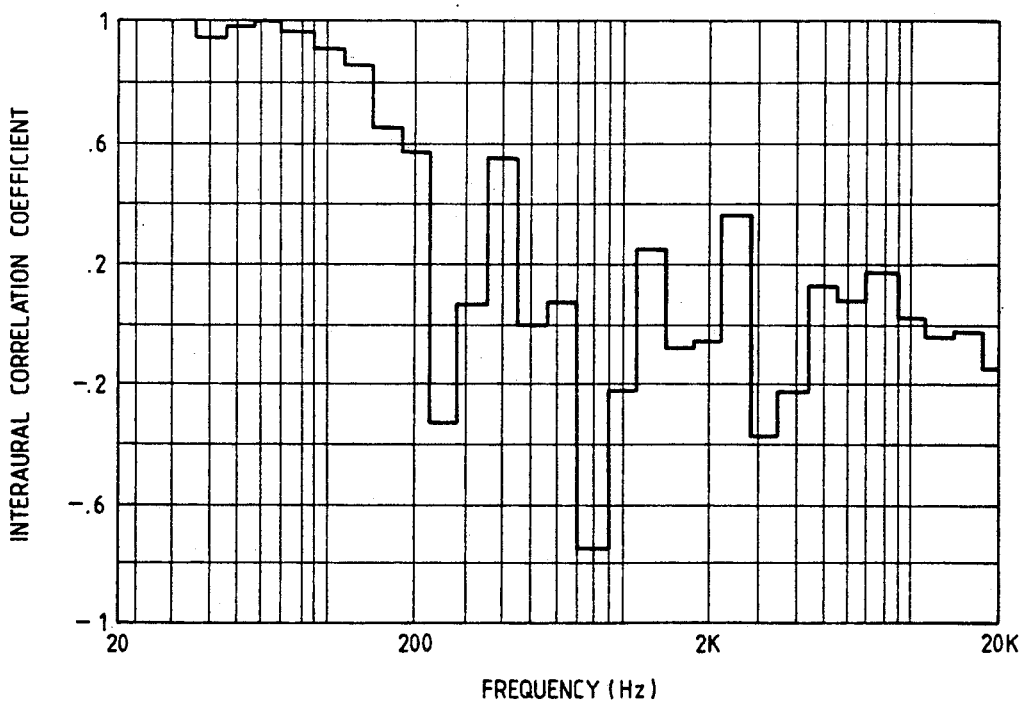
FIG. 2 is a graph showing a relationship between the interaural correlation coefficient and frequency in the device of FIG. 1.

By such a selection of the delay time $\tau_1$, the measured values of the interaural correlation coefficient $\rho LR$ are improved so as to be approximately 0 (zero) or better in the medium frequency region, as shown in FIG. 2.

In the instant embodiment, the delay circuit is inserted in only the Lch direct sound signal line, while no delay circuit is inserted in the Rch direct sound signal line. If required, the delay circuits may be inserted in both the Rch and Lch direct sound signal lines. In this case, a delay time of one of the delay circuits, inserted in the direct sound signal line to which the speaker closer to a listening point is connected, is not always set to be longer than that of the other one. Alternatively, it may be inserted in only the Rch direct sound signal line.

Figure 3:
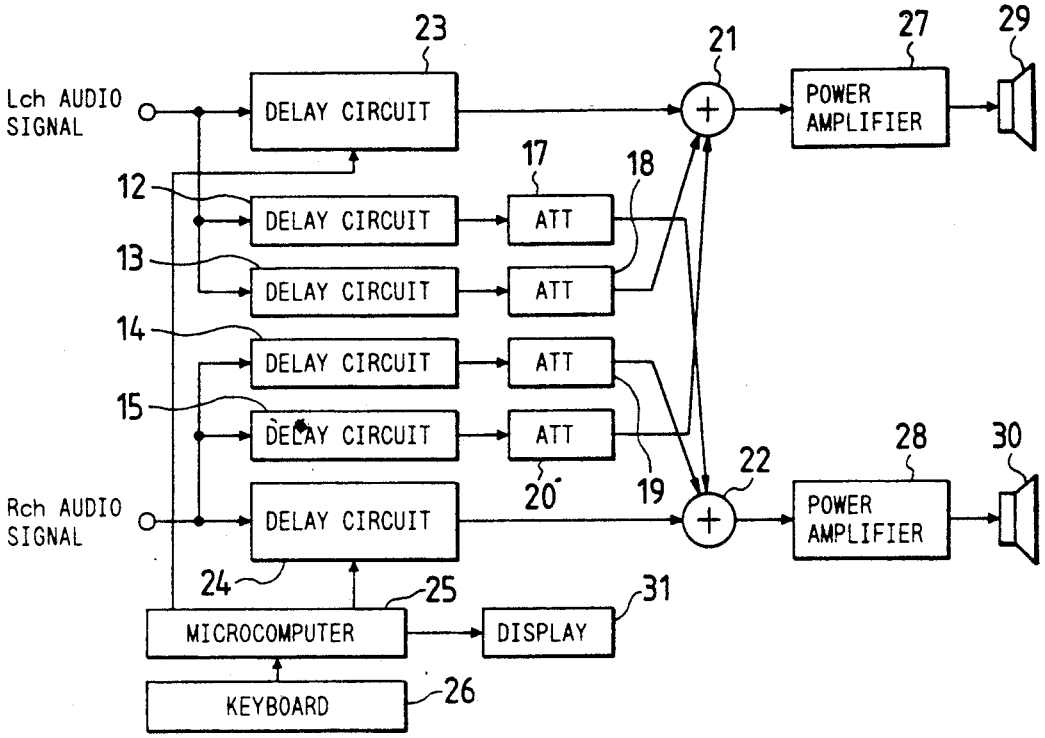
FIG. 3 is a block diagram showing another embodiment of the present invention.

FIG. 3 shows another embodiment of the present invention. In the FIGURE, like or equivalent portions to the portions discussed in the first embodiment of FIG. 1 are designated by like reference numerals. A delay circuit 23 delays a Lch audio signal by a delay time $\tau_1$, and applies the delayed audio signal as a Lch direct sound signal to an adder 21. A delay circuit 24 delays a Rch audio signal by a delay time $\tau_6$, and applies the delayed audio signal as a Rch direct sound signal to an adder 22. The delay circuits 23 and 24 are formed by a digital circuit using a RAM. The delay times $\tau_1$ and $\tau_6$ are individually controlled by a control signal from a microcomputer 25. An example of this type of delay circuit is disclosed in Unexamined Japanese Patent Publication No. 61-165795 and Japanese Utility Model Unexamined Publication No. 62-47300. According to these references, in a write mode, digitized audio signals are stored at memory locations of addresses that are sequentially specified in accordance with sampling periods. In a read mode, a digitized audio signal is read out of a memory location of an address prior to a write address by the value corresponding to a delay time, in response to a control signal derived from the microcomputer 25. Addresses 1 to N are provided. The number of addresses 1 to N are determined by the memory capacity of the RAM. For more details of the digital delay circuit, reference is made to the above-described publications.

Figure 4:
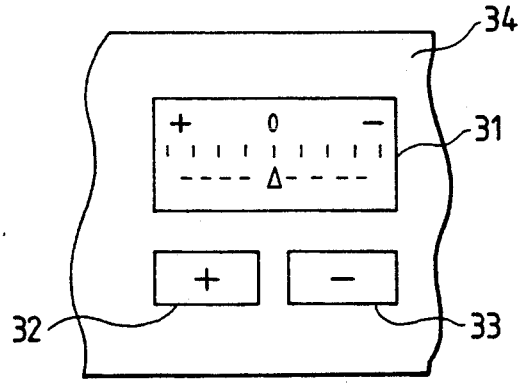
FIG. 4 is a diagram showing a layout of the keys and of the display used in the device of FIG. 3.

The microcomputer 25 is connected to a keyboard 26 and a display 31. As shown in FIG. 4, a (+) key 32 and a (−) key 33 of the keyboard 26, and the display 31 constructed with an LCD, for example, are installed on an operation board 34 of an acoustic apparatus incorporating the instant sound field correcting device.

Figure 5A:
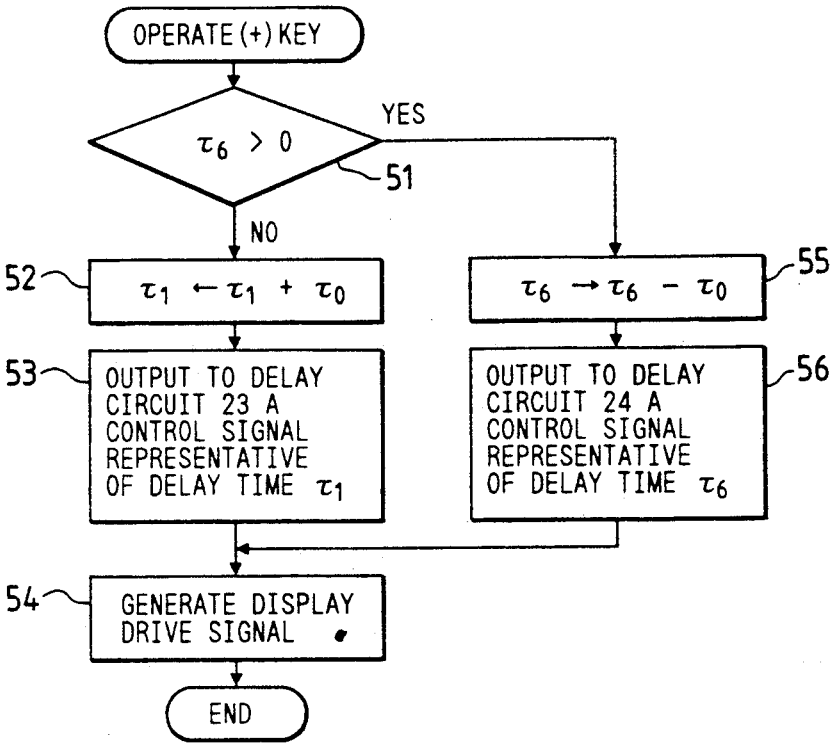
FIGS. 5(*a*) and 5(*b*) are flowcharts showing control programs of the microcomputer used in the device of FIG. 3.
Figure 5B:
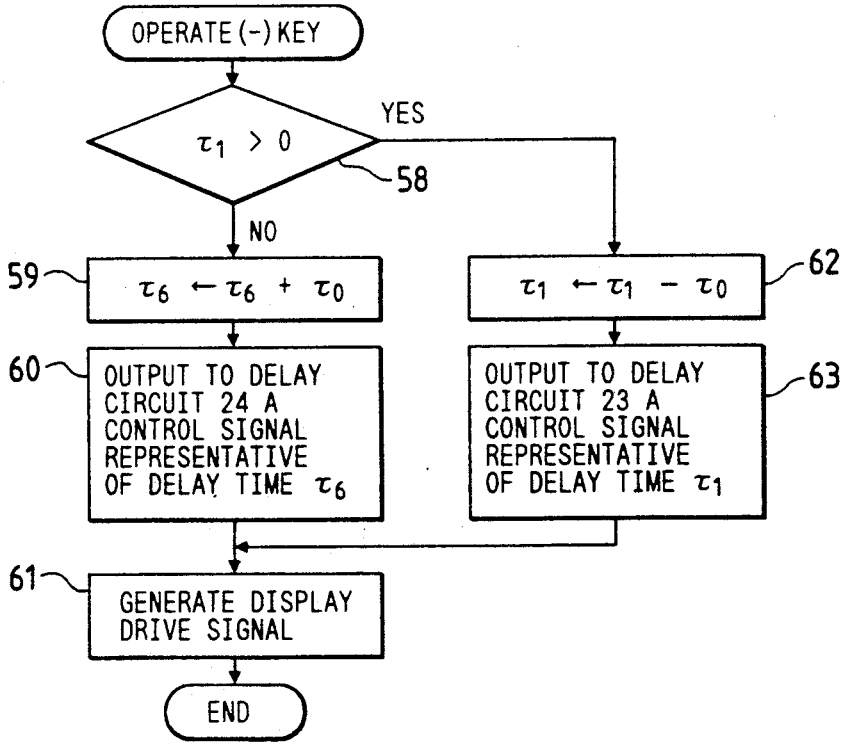
Figure 6:
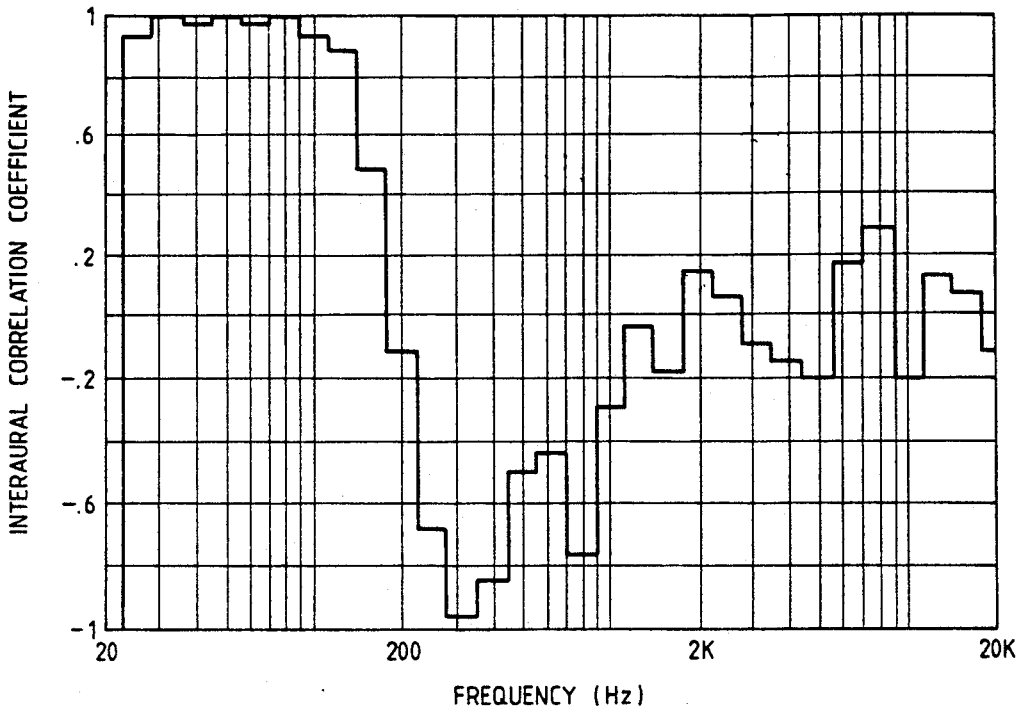
FIG. 6 is a graph showing a relationship between the interaural correlation coefficient and frequency when it is measured at a drive seat of a motor vehicle.
Figure 7A:
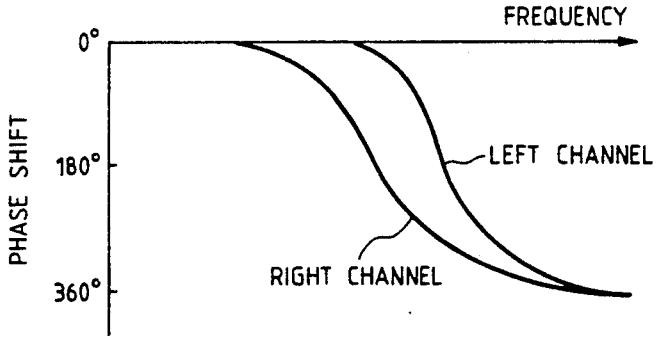
FIG. 7(*a*) is a graph showing a phase shift vs. frequency relationship of an all-pass filter.
Figure 7B:
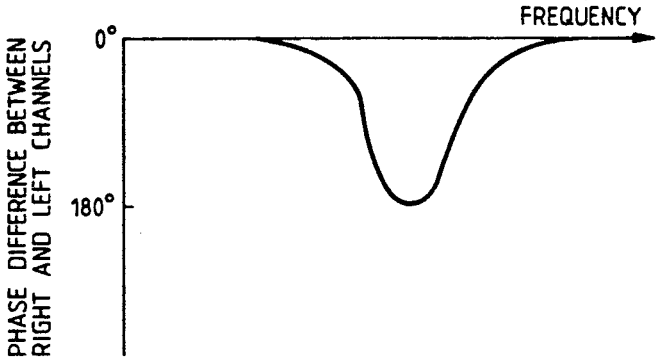

In operation, every time the (+) key 32 is operated, the microcomputer 25 checks to see if the delay time $\tau_6$ of the delay circuit 24 is equal to or larger than 0 (step 51), as shown in FIG. 5(*a*). If $\tau_6=0$, the microcomputer 25 adds a preset time $\tau_0$ to the delay time $\tau_1$ of the delay circuit 23 (step 52). Then, the microcomputer 25 sends a control signal representative of the delay time $\tau_1$ to the delay circuit 23 (step 53). Further, it outputs a display drive signal so as to move a pointer in the display window 31 by one division of a scale toward the (+) side (step 54). In step 51, if $\tau_6>0$, the microcomputer subtracts the preset time $\tau_0$ from the delay time $\tau_6$ (step 55), and sends a control signal representative of the delay time $\tau_6$ to the delay circuit 24 (step 56), and then advances to step 54.

Every time the (−) key 33 is operated, the microcomputer checks to see if the delay time $\tau_1$ of the delay circuit 23 is equal to or larger than 0 (step 58), as shown in FIG. 5(*b*). If $\tau_1=0$, the microcomputer adds the preset time $\tau_0$ to the delay time $\tau_6$ of the delay circuit 24 (step 59). Then, the microcomputer sends a control signal representative of the delay time $\tau_1$ to the delay circuit 24 (step 60). Further, it outputs a display drive signal so as to move a pointer in the display window 31 by one division of a scale toward the (−) side (step 61). If $\tau_1>0$, the microcomputer subtracts the preset time $\tau_0$ from the delay time $\tau_1$ (step 62), and sends a control signal representative of the delay time $\tau_1$ to the delay circuit 23 (step 63), and then advances to step 61.

In this way, the delay times $\tau_1$ and $\tau_6$ of the delay circuits 23 and 24 are set by the user by operating the (+) key 32 and the (−) key 33 of the keyboard 16. Accordingly, it is possible to set up an optimum acoustic space in any ambient condition involving any hearing point, any physical configuration of a listener, any shape of an acoustic space, e.g., a space inside a motor vehicle, any position where speakers are installed, and the like. In the embodiments as mentioned above, the combination of individual components, such as delay circuits and ATTs, is used for forming the sound field correcting device. Those circuits may be formed through digital processing by a DSP (digital signal processor), for example.

As seen from the foregoing description, in a device for correcting a sound field in a narrow space according to the present invention, a delay means is inserted in an audio signal line of at least one of right and left channels. The delay means delays the at least one of the audio signals and causes a predetermined phase difference of the audio signal in a predetermined band width. Even in a situation where a listener is placed at a position unequally distanced from the right and left sound sources, the coefficient $\rho$LR can be made to approach "1" in the predetermined band width. Accordingly, a sound image can be dislocated to the front by inserting the delay means in the audio signal line.

What is claimed is:

1. A device for correcting a sound field in a narrow space, said device being of the type which receives right and left channel audio signals from a sound source, applies said left channel audio signal directly to a first input of a first adding circuit as a direct sound signal of the left channel, applies a delayed version of said left channel audio signal to a second input of said first adding circuit as a pseudo-reflected sound signal, applies a delayed version of said right channel audio signal to a third input of said first adding circuit as a pseudo-reflected sound signal, applies said right channel audio signal directly to a first input of a second adding circuit as a direct sound signal of the right channel, applies a delayed version of said right channel audio signal to a second input of said second adding means as a pseudo-reflected sound signal, applied a delayer version of said left channel audio signal to a third input of said second adding means as a pseudo-reflected sound signal, and outputs said first adding circuit output as a left channel output signal and said second adding circuit output as a right channel output signal, said device further characterized in that:

a delay means is inserted in a signal line of at least one of said direct sound signal of the left channel and said direct sound signal of the right channel.

2. A device according to claim 1, in which a delay time of said delay means is adjustable by a delay time adjustment means.

3. A device according to claim 2 in which said delay time adjustment means comprises:

memory means for storing delay values; and microcomputer means for controlling which delay value stored by said memory means is to be used by said delay means.

4. A device according to claim 3 in which said delay time adjustment means further comprises:

keyboard input means for inputting to said microcomputer means a state of step changes relating to changes in delay time of said delay means so as to allow a listener perceiving said sound field to be able to manually adjust said delay means; and display means for displaying said state of step changes input through said keyboard input means so as to be viewable to said listener.

* * * * *